US007411143B2

(12) United States Patent
Shin et al.

(10) Patent No.: US 7,411,143 B2
(45) Date of Patent: Aug. 12, 2008

(54) FLEXIBLE EL DOME SHEET AND FLEXIBLE EL DOME SHEET KEYPAD USING THE SAME

(75) Inventors: Dong Hyuk Shin, Seoul (KR); Kwang Hyuk Bae, Daejeon (KR)

(73) Assignee: ELK Corporation, Daejeon (KR)

( * ) Notice: Subject to any disclaimer, the term of this patent is extended or adjusted under 35 U.S.C. 154(b) by 101 days.

(21) Appl. No.: 11/579,003

(22) PCT Filed: Mar. 14, 2005

(86) PCT No.: PCT/KR2005/000716

§ 371 (c)(1),
(2), (4) Date: Oct. 30, 2006

(87) PCT Pub. No.: WO2005/125283

PCT Pub. Date: Dec. 29, 2005

(65) Prior Publication Data

US 2007/0221488 A1 Sep. 27, 2007

(30) Foreign Application Priority Data

May 3, 2004 (KR) ..... 10-2004-0031040

(51) Int. Cl.
*H01H 9/00* (2006.01)

(52) U.S. Cl. ..... 200/314; 200/512

(58) Field of Classification Search ..... 200/310–317, 200/512–520; 341/22; 345/168–170; 362/23, 362/29, 84
See application file for complete search history.

(56) References Cited

U.S. PATENT DOCUMENTS 4,060,703 A * 11/1977 Everett, Jr. ..... 200/5 A
5,871,088 A * 2/1999 Tanabe ..... 200/514
5,889,364 A 3/1999 McGuigan et al.
6,198,060 B1 * 3/2001 Yamazaki et al. ..... 200/305
6,284,988 B1 * 9/2001 Watanabe et al. ..... 200/5 A
6,595,653 B2 * 7/2003 Saito et al. ..... 362/84
6,670,750 B2 * 12/2003 Hanahara et al. ..... 313/511
6,696,786 B2 2/2004 Burrows
6,698,085 B2 3/2004 Stevenson et al.
6,753,793 B1 * 6/2004 Kako et al. ..... 341/22
6,765,503 B1 * 7/2004 Chan et al. ..... 341/22

(Continued)

FOREIGN PATENT DOCUMENTS

JP 2000-012213 1/2000

*Primary Examiner*—Michael A Friedhofer
*Assistant Examiner*—Lisa N Klaus
(74) *Attorney, Agent, or Firm*—Oliff & Berridge, PLC

(57) ABSTRACT

A flexible EL dome sheet uses a polymer insulation layer having a thickness of 5 to 50 μm as a substrate, and therefore, the thickness of the flexible EL dome sheet is 50 to 150 μm. The flexible EL dome sheet comprises a flexible EL sheet having key patterns formed thereon and metal or poly domes attached to the EL sheet. Since the flexible EL sheet and the metal or poly domes are used, the flexible EL dome sheet has excellent flexibility and durability, and an additional process for silicon molding is not necessary. Furthermore, the tactile feel of the flexible EL dome sheet keypad is improved. Electric connection between an EL driver of a flexible printed circuit board and the flexible EL sheet is achieved using a contact pad terminal structure, whereby no additional connector is necessary, and therefore, an FPC connecting process is not required.

6 Claims, 4 Drawing Sheets

U.S. PATENT DOCUMENTS 6,824,321 B2 * 11/2004 Ward et al. ..... 400/479
6,984,799 B2 * 1/2006 Kawaguchi et al. ..... 200/512
7,335,843 B2 * 2/2008 Chan et al. ..... 200/310
2003/0041443 A1 3/2003 Stevenson et al.
2007/0242445 A1 * 10/2007 Shin et al. ..... 362/24
2008/0012483 A1 * 1/2008 Shin et al. ..... 313/509

* cited by examiner

FLEXIBLE EL DOME SHEET AND FLEXIBLE EL DOME SHEET KEYPAD USING THE SAME

TECHNICAL FIELD

The present invention relates to a flexible EL dome sheet and a flexible EL dome sheet keypad using the same, and, more particularly, to a flexible EL dome sheet comprising a flexible EL sheet and metal or poly domes and a flexible EL dome sheet keypad using the same.

BACKGROUND ART

Generally, a dome sheet used in a keypad for mobile phones or a membrane switch is manufactured by attaching a plurality of metal or poly domes on predetermined positions of a dome retainer film.

An electro luminescence (hereinafter, referred to as "EL") dome sheet comprises a dome switch and an EL sheet integrally formed at the dome switch. The EL dome sheet is disposed between a printed circuit board and a keypad for illuminating the keypad without an additional light source, such as an LED.

The EL device used in the conventional EL dome sheet uses an ITO sputtered PET film (hereinafter, referred to as "ITO Film") as a substrate. As a result, the thickness of the EL device exceeds 200 μm, which is very large. Consequently, when the EL device is folded or bent, the surface of the ITO film is damaged, and therefore, luminescence is not properly accomplished, and flexibility of the EL device is very poor.

The remainder of the EL device excluding key patterns must be cut, such that the flexibility of the EL device is considerably increased, to utilize the EL device as a keypad, which requires an additional cutting process and an additional high-temperature and high-pressure forming process for silicon molding. In addition, an FPC connecting process for providing a connector to an electric source terminal is required. As described above, several additional processes are necessary, and therefore, productivity is decreased and process difficulty is increased.

DISCLOSURE

Technical Problem

Therefore, the present invention has been made in view of the above problems, and it is an object of the present invention to provide a flexible EL dome sheet that has excellent flexibility and a simple structure, and is easily manufactured, thereby improving productivity, and a flexible EL dome sheet keypad using the same.

Technical Solution

In accordance with one aspect of the present invention, the above and other objects can be accomplished by the provision of a flexible EL dome sheet comprising: a flexible EL sheet composed of a polymer insulation layer having a thickness of 5 to 50 μm, a conductive layer formed on the polymer insulation layer, a dielectric layer formed on the conductive layer, a phosphor layer formed on the dielectric layer, a transparent conductive layer formed on the phosphor layer, and a polymer protection layer formed on the transparent conductive layer, the flexible EL sheet being formed with a thickness of 50 to 150 μm, the flexible EL sheet having key patterns formed thereon; and metal or poly domes attached to the flexible EL sheet such that the metal or poly domes correspond to the key patterns of the flexible EL sheet, respectively, wherein the key patterns of the flexible EL sheet are disposed on the convex surfaces of the metal or poly domes, respectively.

Preferably, the metal or poly domes are attached to the flexible EL sheet by means of a double-sided adhesive tape. Alternatively, the metal or poly domes may be attached to the flexible EL sheet by means of a bonding adhesive.

In accordance with another aspect of the present invention, there is provided a flexible EL dome sheet keypad comprising: a flexible EL dome sheet as mentioned above; a flexible printed circuit board; and a rubber keypad, wherein the flexible printed circuit board comprises: an EL driver connected to the flexible EL sheet of the flexible EL dome sheet for supplying AC voltage to the flexible EL sheet; and a plurality of unit circuits each including a contact point corresponding to one of the metal or poly domes, and a central processing unit for transmitting a signal to the EL driver such that the AC voltage is supplied to the flexible EL sheet when the metal or poly dome comes into contact with the contact point, the number of the unit circuits being equal to that of the metal or poly domes, and the rubber keypad has keys patterned thereon such that the keys correspond to the key patterns formed on the flexible EL sheet, respectively, the rubber keypad being disposed on the surface of the flexible EL dome sheet where the metal or poly domes are not attached.

Preferably, the flexible EL sheet is electrically connected to the EL driver of the flexible printed circuit board via a contact pad.

Advantageous Effects

According to the present invention with the above-stated construction, the flexible EL sheet has a thickness of approximately 100 μm, and the metal or poly domes have excellent resilient forces. Consequently, the flexibility of the flexible EL dome sheet keypad according to the present invention is excellent as compared to the prior art, and therefore, the flexible EL dome sheet keypad has excellent physical durability. As a result, the EL sheet is prevented from being damaged even after the flexible EL dome sheet keypad according to the preferred embodiment of the present invention has been used hundreds of thousand times. Furthermore, the tactile feel of the flexible EL dome sheet keypad is improved, and therefore, an additional process for silicon molding is not necessary.

In addition, electric connection between the EL driver of the flexible printed circuit board and the flexible EL sheet is achieved using the contact pad terminal, whereby an additional connector for electric connection is not necessary, and therefore, an FPC connecting process is not required.

DESCRIPTION OF DRAWINGS

The above and other objects, features and other advantages of the present invention will be more clearly understood from the following detailed description taken in conjunction with the accompanying drawings, in which.

BEST MODE

Now, a preferred embodiment of the present invention will be described in detail with reference to the accompanying drawings.

Figure 1:
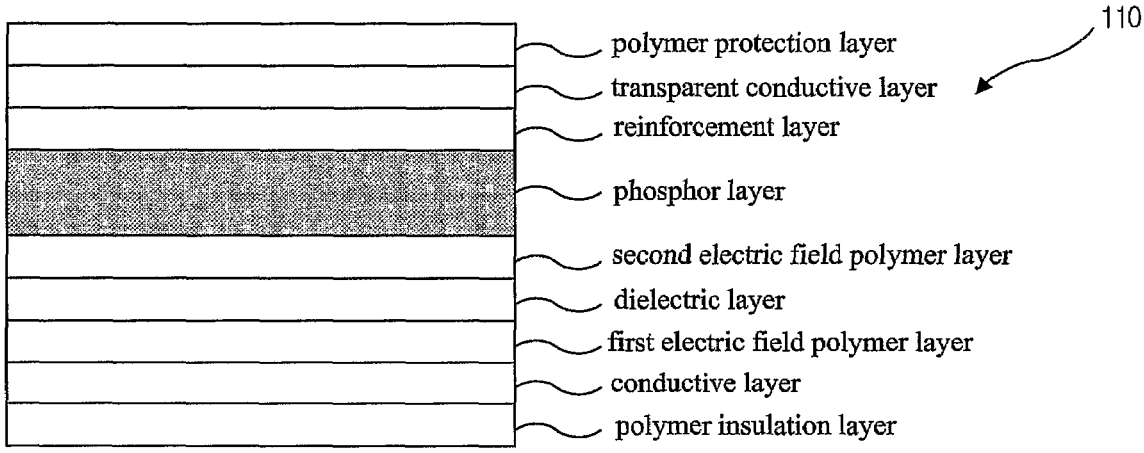
FIG. 1 is a view schematically showing a flexible EL sheet.

FIG. 1 is a view schematically showing a flexible EL sheet.

Referring to FIG. 1, the flexible EL sheet 110 is composed of: a polymer insulation layer having a thickness of 5 to 50 μm; a conductive layer formed on the polymer insulation layer, the conductive layer having a thickness of 3 to 15 μm; a first electric field polymer layer formed on the conductive layer, the first electric field polymer layer having a thickness of 1 to 3 μm; a dielectric layer formed on the first electric field polymer layer, the dielectric layer having a thickness of 3 to 25 μm; a second electric field polymer layer formed on the dielectric layer, the second electric field polymer layer having a thickness of 1 to 3 μm; a phosphor layer formed on the second electric field polymer layer, the phosphor layer having a thickness of 30 to 50 μm; a reinforcement layer formed on the phosphor layer, the reinforcement layer having a thickness of 1 to 3 μm; a transparent conductive layer formed on the reinforcement layer, the transparent conductive layer having a thickness of less than 10 μm; and a polymer protection layer formed on the transparent conductive layer, the polymer protection layer having a thickness of 5 to 50 μm. Consequently, the total thickness of the flexible EL sheet is 50to 150 μm. The respective layers are formed preferably by screen printing. The first electric field polymer layer, the second electric field polymer layer and the reinforcement layer are formed to improve the electro-optical characteristics of the flexible EL sheet. It should be noted, however, that the first electric field polymer layer, the second electric field polymer layer and the reinforcement layer are not essential components of the present invention, and therefore, the first electric field polymer layer, the second electric field polymer layer and the reinforcement layer may be omitted.

It is required that the material for the polymer insulation layer not react with various solvents after the material for the polymer insulation layer is hardened, and the material for the polymer insulation layer have an excellent moisture-proof property. As the material for the polymer insulation layer, for example, polymer hardened by infrared (IR) or ultraviolet (UV) irradiation may be used. The conductive layer is composed of a mixture of conductive powder and binder, conductive organic polymer, or a mixture of conductive powder and conductive organic polymer. As the conductive powder, for example, copper powder coated with silver, carbon powder, or silver powder may be used. As the conductive organic polymer, for example, 3,4-ethylenedioxythiophene (PEDOT:PSS) or polyethylenethioxythiophene (PEDOT:PSS) may be used. As the first electric field polymer layer, a material having a high dielectric constant, such as cyanoethyl pullulan or fluororesin, may be used. The dielectric layer is composed of a mixture of dielectric powder and binder. As the dielectric powder, dielectric powder having a high dielectric constant, such as $BaTiO_3$, may be used. The size of the dielectric powder is 0.1 to 10 μm. As the binder of the dielectric layer, polymer having a high dielectric constant, such as cyanoethyl pullulan or fluororesin, may be used. The second electric field polymer layer 150 is composed of polymer having a high dielectric constant. As the polymer having the high dielectric constant, cyanoethyl pullulan or fluororesin may be used. The phosphor layer is composed of a mixture of phosphor powder and binder. As the phosphor powder, Group II to Group IV compounds, such as ZnS, may be used. Preferably, the binder used in the phosphor layer has a dielectric constant higher than that of the phosphor powder. As the binder having the high dielectric constant, cyanoethyl pullulan or fluororesin may be used. The reinforcement layer is composed of polymer having a high dielectric constant or a compound such as $BaTiO_3$ having a size of 0.1 to 10 μm and polymer having a high dielectric constant. As the polymer having the high dielectric constant, cyanoethyl pullulan or fluororesin may be used. Fluorescent paints or fluorescent dyes, such as rhodamine, may be mixed with the binder of the phosphor layer to change illuminating colors of the device. The transparent conductive layer may be composed of a mixture of ITO powder and binder, an ITO thin film layer formed by sputtering, conductive organic polymer, or a compound of conductive organic polymer and ITO. As the conductive organic polymer, for example, 3,4-ethylenedioxythiophene (PEDOT:PSS) or polyethylenethioxythiophene (PEDOT:PSS) may be used.

In the flexible EL sheet 110 with the above-stated construction, the polymer insulation layer having a thickness of 5 to 50 μm is used instead of the ITO sputtered PET substrate having a thickness of 75 to 200 μm, which is usually used in the prior art. Consequently, the thickness of the flexible EL sheet is approximately ¼ that of the conventional EL device, and therefore, flexibility of the device is significantly improved.

A flexible EL dome sheet comprises: a flexible EL sheet having key patterns formed thereon; and metal domes or poly domes attached to the flexible EL sheet. Specifically, the metal domes or the poly domes are attached to the flexible EL sheet by means of a double-sided adhesive tape or a bonding adhesive such that the key patterns of the flexible EL sheet are placed on the convex surfaces of the metal domes or the poly domes. Hereinafter, the metal domes or the poly domes will be referred to as metal domes.

Consequently, the flexible EL dome sheet according to the preferred embodiment of the present invention has the following advantages. The metal or poly domes do not need to be attached to the dome retainer film as in the prior art. Furthermore, the metal domes are easily attached to the EL sheet by means of the double-sided adhesive tape or the bonding adhesive, and therefore, the whole process is simplified. In addition, the thickness of the flexible EL dome sheet, and therefore, flexibility of the flexible EL dome sheet is significantly improved, and no additional cutting process is required.

Figure 2:
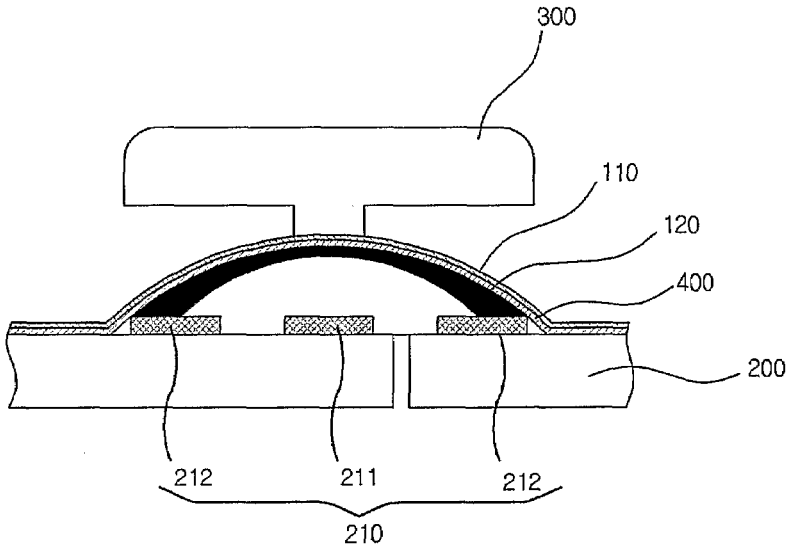
FIGS. 2 and 3 are views schematically showing a flexible EL dome sheet keypad according to a preferred embodiment of the present invention.
Figure 3:
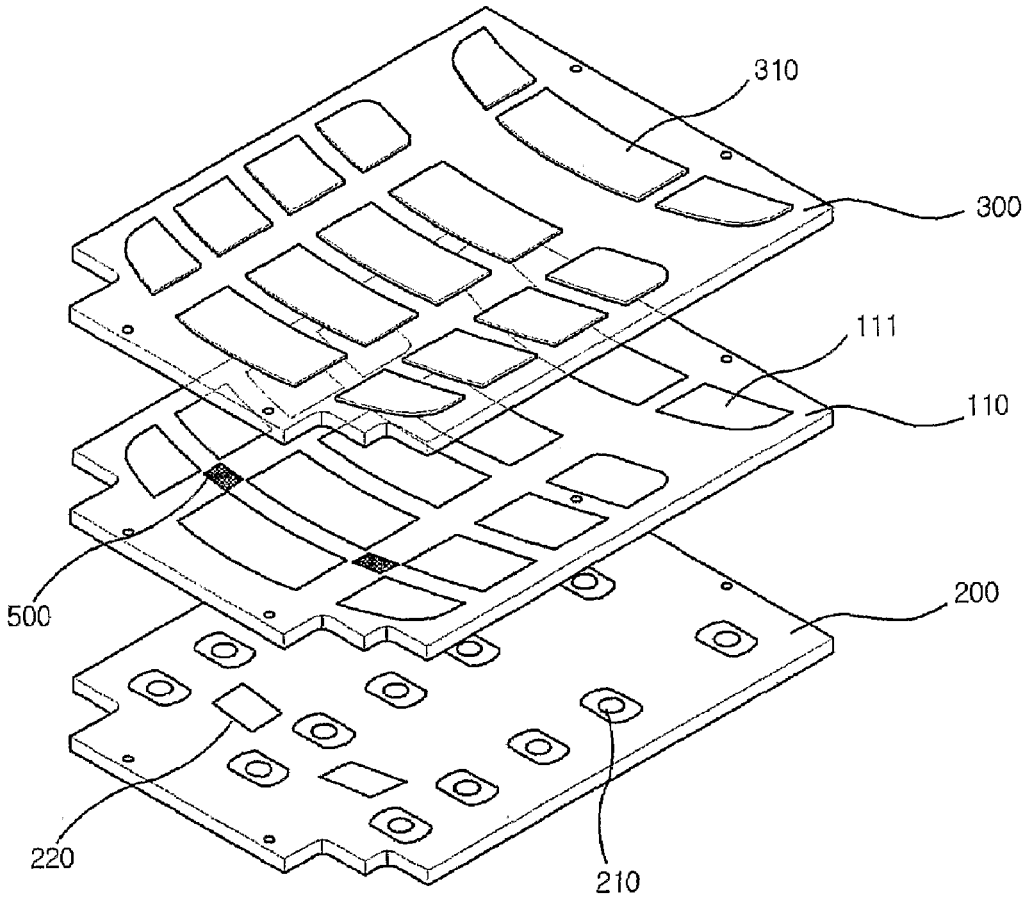
Figure 4:
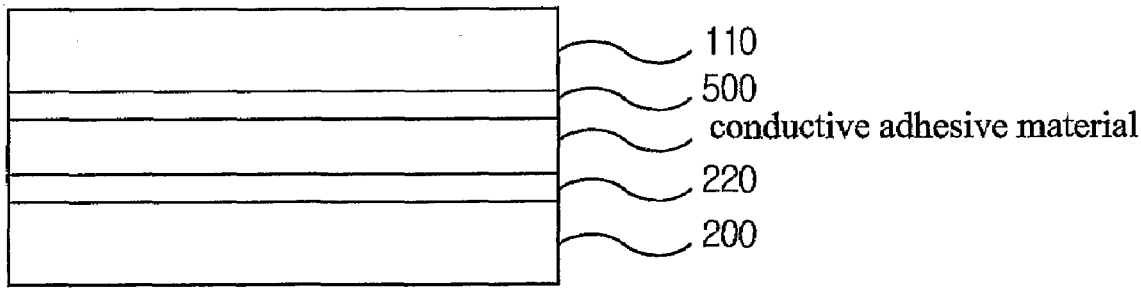
FIG. 4 is a view schematically showing connection of a flexible EL sheet and a flexible printed circuit board via a contact pad terminal.
Figure 5:
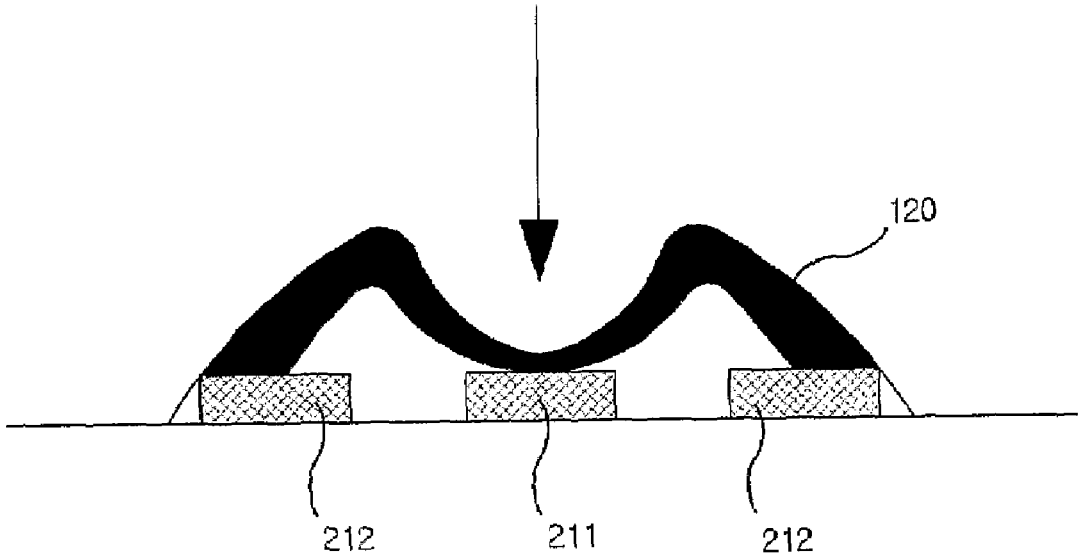
FIGS. 5 and 6 are views schematically illustrating the operation of the flexible EL dome sheet keypad shown in FIGS. 2 to 4.
Figure 6:
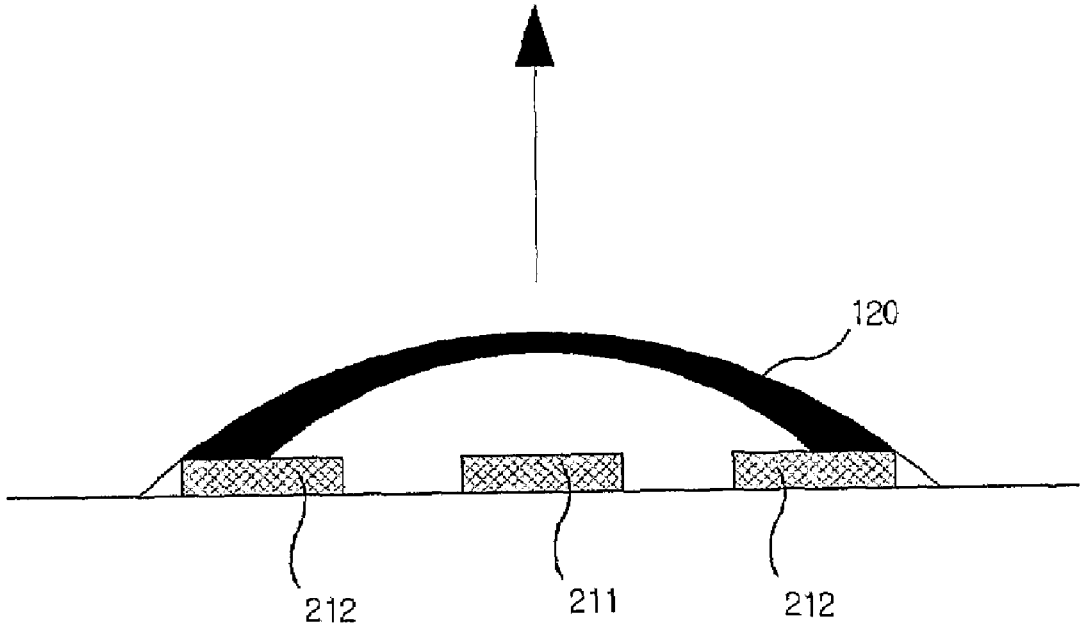

FIGS. 2 and 3 are views schematically showing a flexible EL dome sheet keypad according to a preferred embodiment of the present invention, FIG. 4 is a view schematically showing connection of a flexible EL sheet and a flexible printed circuit board via a contact pad terminal, and FIGS. 5 and 6 are views schematically illustrating the operation of the flexible EL dome sheet keypad shown in FIGS. 2 to 4.

Referring to FIGS. 2 to 4, the flexible EL dome sheet keypad according to the preferred embodiment of the present invention comprises: a flexible EL dome sheet composed of the flexible EL sheet 110 and the metal domes 120 attached to the flexible EL sheet by means of the double-sided adhesive tape 400; a flexible printed circuit board 200; a rubber keypad 300; and a contact pad terminal 500. The construction of the flexible EL dome sheet has been described in detail above, and therefore, a further detailed description of the flexible EL dome sheet will not be given.

The flexible EL dome sheet 200 comprises a plurality of unit circuits 210 and an EL driver 220.

The EL driver 220 is connected to the flexible EL sheet via the contact pad terminal, which will be described in detail below. The EL driver 220 receives signals from central processing unit 212, which will be described in detail below, included in the respective unit circuits 210 , to supply electric current to the flexible EL sheet 110.

Each of the unit circuits 210 comprises: a contact point 211 corresponding to one of the metal domes 120; and a central processing unit 212 for transmitting a signal to the EL driver 220 such that AC voltage is supplied to the flexible EL sheet 110 when the metal dome 120 comes into contact with the contact point 211. The number of the unit circuits 210 is equal to or greater than that of the metal domes 120, i.e., the key patterns 111. This is because some of the keys are opaque, and therefore, they do not require light emitting function. Consequently, the number of the unit circuits 210 is equal to or greater than that of the key patterns 111.

On the rubber keypad 300 are patterned keys 310, which correspond to the key patterns 111 formed on the flexible EL sheet 110, respectively. The rubber keypad 300 is disposed on the surface of the flexible EL dome sheet.

The contact pad terminal 500 is formed at the surface of the flexible EL sheet 110 where light is not emitted. According to the present invention, the flexible EL sheet 110 is electrically connected to the EL driver 220 of the flexible printed circuit board 200 via the contact pad terminal 500. Consequently, an additional connector for electric connection therebetween is not necessary, and therefore, an FPC connecting process is not required. In order to improve reliable electric connection therebetween, a plurality of contact pad terminals may be formed on the flexible EL sheet.

Referring to FIGS. 5 and 6 in connection with FIGS. 2 to 4, when a user pushes one of the keys 310 patterned on the rubber keypad 300, one of the metal domes 120, which corresponds to the pushed key 310, is pressed. Consequently, the pressed metal dome 120 comes into contact with the contact point 211 included in one of the unit circuits 210 of the flexible printed circuit board 200, which corresponds to the pressed metal dome 120. As a result, the central processing unit 212 of the unit circuit 210 having the contact point 211 contacting the pressed metal dome outputs an supplying AC voltage signal to the EL driver 220, and therefore, the EL driver 220 supplies the AC voltage to the flexible EL sheet 110 via the contact pad terminal 500. Consequently, all of the key patterns 111 of the flexible EL sheet 110 emit light.

When the user withdraws his/her finger from the rubber keypad 300, the metal dome 120 is returned to its original position by a restoring force of the metal dome 120.

As described above, the flexible EL sheet has a thickness of approximately 100 μm, and the metal domes have excellent restoring forces. Consequently, the flexible EL dome sheet keypad according to the preferred embodiment of the present invention can be easily pushed, and therefore, the tactile feel of the flexible EL dome sheet keypad is improved. Furthermore, the flexibility of the flexible EL dome sheet keypad according to the preferred embodiment of the present invention is excellent as compared to the prior art, and therefore, the flexible EL dome sheet keypad according to the preferred embodiment of the present invention has excellent physical durability. As a result, the EL sheet is prevented from being damaged even after the flexible EL dome sheet keypad according to the preferred embodiment of the present invention has been pressed repeatedly.

A method of manufacturing the flexible EL dome sheet keypad according to the preferred embodiment of the present invention will be described hereinafter in detail.

Figure 7:
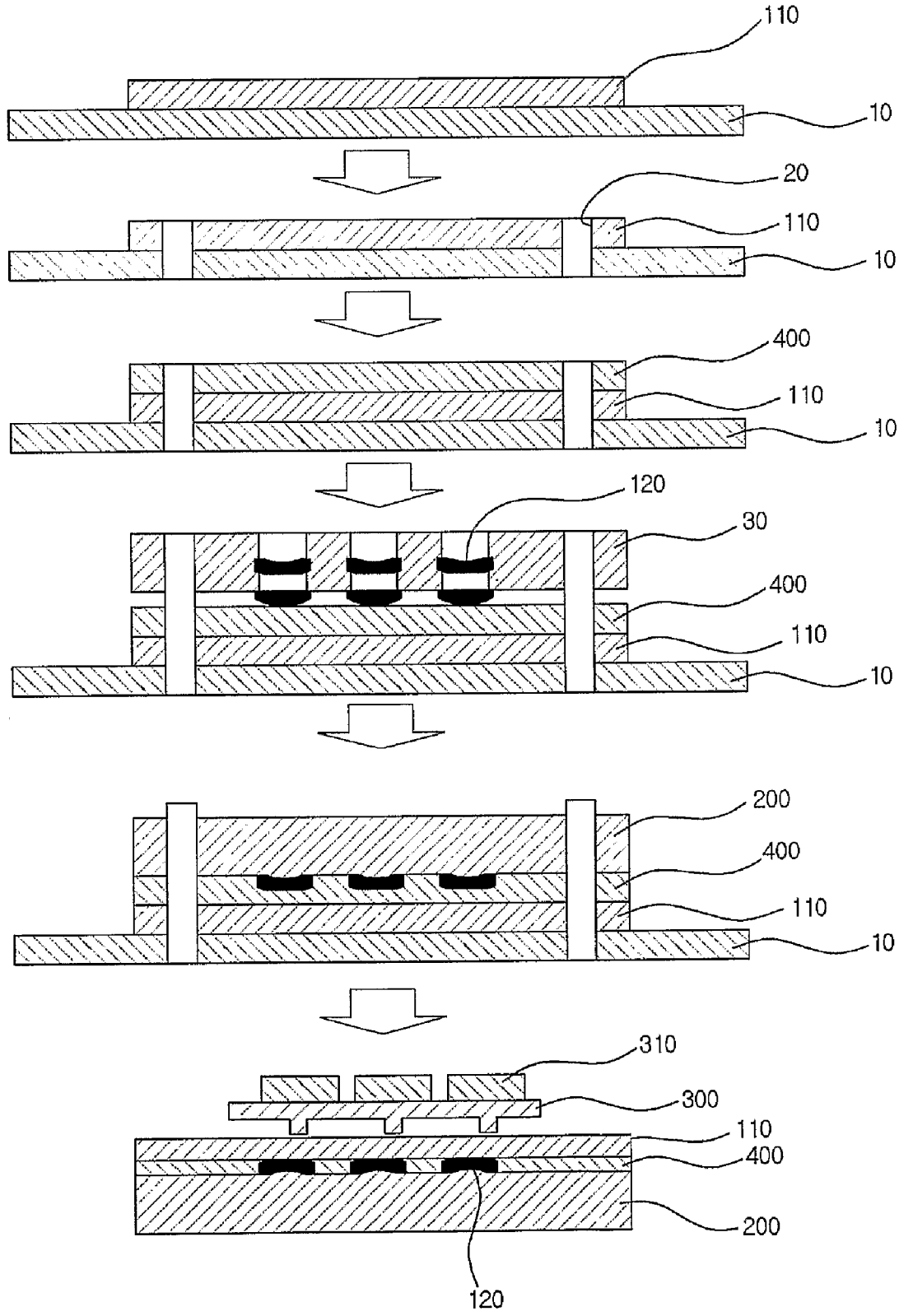
FIG. 7 is a flow chart illustrating a method of manufacturing the flexible EL dome sheet keypad according to the preferred embodiment of the present invention.

FIG. 7 is a flow chart illustrating the method of manufacturing the flexible EL dome sheet keypad according to the preferred embodiment of the present invention.

First, the flexible EL sheet 110 is formed on a carrier film 10. The carrier film 10 is provided to allow easy handling of the flexible EL sheet 110 because the flexible EL sheet 110 is thin. Consequently, the carrier film 10 is not an essential component of the present invention. Then, guide holes 20 for aligning the metal domes 120 or the flexible printed circuit board 200 are formed at the flexible EL sheet 110.

Subsequently, the double-sided adhesive tape 400 is applied to one surface of the flexible EL sheet 110.

After that, the respective metal domes 120 are attached to the surface of the flexible EL sheet 110 where the double-sided adhesive tape 400 is applied by means of a previously prepared dome jig 30 such that the metal domes 120 correspond to the respective key patterns formed at the flexible EL sheet 110.

Subsequently, the product obtained from the above-mentioned processes is attached to the flexible printed circuit board 200 such that the contact points formed at the flexible printed circuit board 200 correspond to the metal domes 120, respectively. After the carrier film 10 is removed, the rubber keypad 300 is attached to the surface of the flexible EL sheet 110 where the metal domes 120 are not attached such that the keys 310 formed at the rubber keypad 300 correspond to the key patterns formed at the flexible EL sheet 110, respectively. In this way, the flexible EL dome sheet keypad is completed. In this case, electric connection in the flexible EL dome sheet keypad according to the preferred embodiment of the present invention may be achieved in a contact pad connection fashion.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

The invention claimed is:

1. A flexible EL dome sheet comprising:

a flexible EL sheet composed of a polymer insulation layer having a thickness of 5 to 50 um, a conductive layer formed on the polymer insulation layer, a dielectric layer formed on the conductive layer, a phosphor layer formed on the dielectric layer, a transparent conductive layer formed on the phosphor layer, and a polymer protection layer formed on the transparent conductive layer, the flexible EL sheet being formed with a thickness of 50 to 150 um, the flexible EL sheet having key patterns formed thereon; and metal or poly domes attached to the flexible EL sheet such that the metal or poly domes correspond to the key patterns of the flexible EL sheet, respectively, wherein the key patterns of the flexible EL sheet are disposed on the convex surfaces of the metal or poly domes, respectively.

2. The sheet as set forth in claim 1, further comprising:

a first electric field polymer layer disposed between the conductive layer and the dielectric layer, a second electric field polymer layer disposed between the dielectric layer and the phosphor layer, and a reinforcement layer disposed between the phosphor layer and the transparent conductive layer.

3. The sheet as set forth in claim 1, wherein the metal or poly domes are attached to the flexible EL sheet by means of a double-sided adhesive tape.

4. The sheet as set forth in claim 1, wherein the metal or poly domes are attached to the flexible EL sheet by means of a bonding agent.

5. A flexible EL dome sheet keypad comprising: the flexible EL dome sheet as set forth in claims 1; a flexible printed circuit board; and a rubber keypad, wherein the flexible printed circuit board comprises: an EL driver connected to the flexible EL sheet of the flexible EL dome sheet for supplying AC voltage to the flexible EL sheet; and a plurality of unit circuits each including a contact point corresponding to one of the metal or poly domes, and a central processing unit for transmitting a signal to the EL driver such that the AC voltage is supplied to the flexible EL sheet when the metal or poly dome comes into contact with the contact point, the number of the unit circuits being equal to that of the metal or poly domes, and the rubber keypad has keys patterned thereon such that the keys correspond to the key patterns formed on the flexible EL sheet, respectively, the rubber keypad being disposed on the surface of the flexible EL dome sheet where the metal or poly domes are not attached.

6. The keypad as set forth in claim 5, wherein the flexible EL sheet is electrically connected to the EL driver of the flexible printed circuit board via a contact pad.

* * * * *